US011233379B2

(12) United States Patent
Mack

(10) Patent No.: US 11,233,379 B2
(45) Date of Patent: Jan. 25, 2022

(54) SPARK PLUGS VIA SURFACE MODIFICATIONS

(71) Applicant: University of Massachusetts, Boston, MA (US)

(72) Inventor: John Hunter Mack, Arlington, MA (US)

(73) Assignee: University of Massachusetts, Boston, MA (US)

( * ) Notice: Subject to any disclaimer, the term of this patent is extended or adjusted under 35 U.S.C. 154(b) by 0 days.

(21) Appl. No.: 16/872,111

(22) Filed: May 11, 2020

(65) Prior Publication Data

US 2020/0358262 A1 Nov. 12, 2020

Related U.S. Application Data

(60) Provisional application No. 62/846,573, filed on May 10, 2019.

(51) Int. Cl.
*H01T 13/32* (2006.01)
*H01T 13/52* (2006.01)

(52) U.S. Cl.
CPC ..... *H01T 13/32* (2013.01); *H01T 13/52* (2013.01)

(58) Field of Classification Search
CPC ..... H01T 13/32; H01T 13/52
See application file for complete search history.

(56) References Cited

U.S. PATENT DOCUMENTS 4,109,633 A * 8/1978 Mitsudo ..... H01T 13/20 123/169 EL
4,329,615 A * 5/1982 Tanaka ..... H01T 13/20 313/139
7,015,633 B2 3/2006 Makino et al.
2004/0036395 A1* 2/2004 Makino ..... H01T 13/39 313/141
2011/0253104 A1* 10/2011 McAlister ..... F02D 41/38 123/445
2020/0366068 A1* 11/2020 Maki ..... B23K 26/351

FOREIGN PATENT DOCUMENTS

JP 6138712 B * 5/2017

OTHER PUBLICATIONS

Kodama et al, Japanese Patent JP6138712B, May 17, Machine Translation (Year: 2017).*

(Continued)

*Primary Examiner* — Tracie Y Green
(74) *Attorney, Agent, or Firm* — Hamilton, Brook, Smith & Reynolds, P.C.

(57) ABSTRACT

Lean-burn engines are important due to their ability to reduce emissions, increase fuel efficiency, and mitigate engine knock. Embodiments of a spark plug with a nano-structured electrode extend the lean flammability limit of natural gas. A nano-/micro-morphology modification is applied on a surface of the spark plug electrode to increase its surface roughness. Measurements indicate that the lean flammability limit of spark-ignited methane can be lowered by modulating the surface roughness of the spark plug electrode with nanostructures.

10 Claims, 10 Drawing Sheets

(56) References Cited

OTHER PUBLICATIONS

Askari et al., "On the flame stability and laminar burning speeds of syngas/O 2/He premixed flame," Fuel, vol. 190, pp. 90-103, 2017.
Bane, et al., "Investigation of the effect of electrode geometry on spark ignition," Combustion and Flame, vol. 162, No. 2, pp. 462-469, 2015.
J. E. Dec, "Advanced compression-ignition engines—understanding the in-cylinder processes," Proceedings of the combustion institute, vol. 32, No. 2, pp. 2727-2742, 2009.
Shahsavan et al., "Mixedness Measurement in Gaseous Jet Injection," in American Society for Engineering Education Northeast Section (ASEE-NE) Annual Conference, Lowell, MA, 2017.
Shahsavan et al., "The Effect of Heavy Working Fluids on Hydrogen Combustion," in 10th US National Combustion Meeting, College Park, MD, 2017.
Sjöberg et al., "Combined effects of fuel and dilution type on efficiency gains of lean well-mixed DISI engine operation with enhanced ignition and intake heating for enabling mixed-mode combustion," SAE International Journal of Engines, vol. 9, No. 2016-01-0689, pp. 750-767, 2016.
Voshtani et al., "Investigating various effects of reformer gas enrichment on a natural gas-fueled HCCI combustion engine," International Journal of Hydrogen Energy, vol. 39, No. 34, pp. 19799-19809, Nov. 20, 2014/ 2014.
Morovatiyan et al., "Investigation of the Effect of Electrode Surface Roughness on Spark Ignition," Proceedings of the ASME 2018 Internal Combustion Fall Technical Conference, Nov. 4-7, 2018, San Diego, CA.
Ansari et al., "Efficiency and Emissions Mapping of a Light Duty Diesel-Natural Gas Engine Operating in Conventional Diesel and RCCI Modes," SAE Technical Paper 0148-7191, 2016.
A. A. Abdel-Rehim, "Impact of spark plug number of ground electrodes on engine stability," Ain Shams Engineering Journal, vol. 4, No. 2, pp. 307-316, 2013.
Badawy et al., "Impact of spark plug gap on flame kernel propagation and engine performance," Applied energy, vol. 191, pp. 311-327, 2017.
S. Berger, "Onset or breakdown voltage reduction by electrode surface roughness in air and SF 6," IEEE Transactions on Power Apparatus and Systems, vol. 95, No. 4, pp. 1073-1079, 1976.
Bogin et al., "Homogeneous charge compression ignition (HCCI) engine," SAE International Journal of Fuels and Lubricants, vol. 2, No. 2009-01-1805, pp. 817-826, 2009.
Cashdollar et al., "Flammability of methane, propane, and hydrogen gases," Journal of Loss Prevention in the Process Industries, vol. 13, No. 3-5, pp. 327-340, 2000.
Holley et al., "Ignition and extinction of non-premixed flames of single-component liquid hydrocarbons, jet fuels, and their surrogates," Proceedings of the Combustion Institute, vol. 31, No. 1, pp. 1205-1213, 2007.
Johnson et al., "Methods to Improve Combustion Stability, Efficiency, and Power Density of a Small, Port-Injected, Spark-Ignited, Two-Stroke Natural Gas Engine," in ASME 2017 Internal Combustion Engine Division Fall Technical Conference, 2017, pp. V002T07A008-V002T07A008: American Society of Mechanical Engineers.
G. T. Kalghatgi, "Spark ignition, early flame development and cyclic variation in IC engines," SAE Technical Paper 0148-7191, 1987.
R. Moos et al, "Temperature-independent resistive oxygen exhaust gas sensor for lean-burn engines in thick-film technology," Sensors and Actuators B: Chemical, vol. 93, No. 1, pp. 43-50, Aug. 1, 2003/ 2003.
Morovatiyan et al., "Development of a 3D CFD model to analyze gas exchange process into intake manifold of an iVVT engine," The Journal of Engine Research, vol. 36, No. 36, pp. 51-60, 2014.
Morovatiyan et al., "Development of a Constant Volume Combustion Chamber for Material Synthesis," in Eastern States Section of the Combustion Institute Spring Technical Meeting, State College, PA, 2018.
Perin et al., "Lean Burn Engines," SAE Technical Paper 0148-7191, 2013.
Pickett et al, "Diesel fuel jet lift-off stabilization in the presence of laser-induced plasma ignition," Proceedings of the Combustion Institute, vol. 32, No. 2, pp. 2793-2800, 2009.
Reitz et al, "Review of high efficiency and clean reactivity controlled compression ignition (RCCI) combustion in internal combustion engines," Progress in Energy and Combustion Science, vol. 46, pp. 12-71, 2015.
Sato et al., "Relationship between electrode surface roughness and impulse breakdown voltage in vacuum gap of Cu and Cu-Cr electrodes," IEEE transactions on dielectrics and electrical insulation, vol. 10, No. 4, pp. 576-582, 2003.
Seshadri et al., "Experimental and kinetic modeling study of combustion of JP-8, its surrogates and components in aminar premixed flows," Combustion Theory and Modelling, vol. 15, No. 4, pp. 569-583, 2011.
Shahsavan et al., "The Influence of Mixedness on Ignition for Hydrogen Direct Injection in a Constant Volume Combustion Chamber," in Eastern States Section of the Combustion Institute Spring Technical Meeting, State College, PA, 2018.
Shahsavan et al., "A numerical investigation of hydrogen injection into noble gas working fluids," International Journal of Hydrogen Energy, vol. 43, No. 29, pp. 13575-13582, 2018.
Shahsavan et al., "Numerical study of a boosted HCCI engine fueled with n-butanol and isobutanol," Energy Conversion and Management, vol. 157, pp. 28-40, 2018.
Shen et al., "High-density regular arrays of nanometer-scale rods formed on silicon surfaces via femtosecond laser irradiation in water," Nano letters, vol. 8, No. 7, pp. 2087-2091, 2008.
Shenghua et al., "Study of spark ignition engine fueled with methanol/gasoline fuel blends," Applied Thermal Engineering, vol. 27, No. 11-12, pp. 1904-1910, 2007.
Shoshin et al., "Experimental study of lean flammability limits of methane/hydrogen/air mixtures in tubes of different diameters," Experimental Thermal and Fluid Science, vol. 34, No. 3, pp. 373-380, 2010.
Song et al., "Performance of a controllable premixed combustion engine fueled with dimethyl ether," Energy conversion and management, vol. 45, No. 13-14, pp. 2223-2232, 2004.
Wang et al., "Flame structure and laminar burning speed of gas to liquid fuel air mixtures at moderate pressures and high temperatures," Fuel, vol. 209, pp. 529-537, Dec. 1, 2017/ 2017.
Wolk et al., "Enhancement of flame development by microwave-assisted spark ignition in constant volume combustion chamber," Combustion and flame, vol. 160, No. 7, pp. 1225-1234, 2013.

* cited by examiner

300

SPARK PLUGS VIA SURFACE MODIFICATIONS

RELATED APPLICATION

This application claims the benefit of U.S. Provisional Application No. 62/846,573, filed on May 10, 2019. The entire teachings of the above application are incorporated herein by reference.

BACKGROUND

Spark plugs are an important part of many internal combustion engines. They provide energy needed to ignite a combustible mixture of fuel and air. Ignition in a combustible mixture is defined as a heat transfer process that is initiated at a longer time in comparison with the time for an electrical breakdown of the mixture between the electrodes. There are various studies about different types of ignition systems, such as spark ignition (SI), compression ignition (CI), plasma ignition, and microwave-assisted ignition, to ignite the combustible mixture for converting chemical energy to mechanical energy. SI engines typically utilize an external heat source (e.g., spark plug) to ignite the mixture in the cylinders.

The spark ignition is initiated with a spark using an external heat origin like a spark plug to perform as an ignitor. The composition of a spark needs an avalanche of electrons discharged between electrodes. According to Townsend theory, a large swift supply of electrons produces fresh ions and electrons that leads to a transient discharge. If the discharge that happens from a cathode (positive terminal) to an anode (negative terminal) has enough energy to ionize gas, the electrode gap is bridged to make a transition between ionized gases from weaker to stronger. This transition is typically called a spark, and an area between the electrodes is referred to as a spark channel. According to earlier studies, the spark discharge is dependent on several factors, such as an electrode gap length, electrode shape, electrode material, gas pressure, applied voltage, and discharge circuit.

SUMMARY

Example embodiments include a spark plug having a first electrode and a second electrode. At least one of the first electrode and second electrode define features having a surface roughness in a direction of the spark gap.

The first electrode may be a cathode electrode and the second electrode may be an anode electrode, and the anode electrode and/or the cathode electrode may define the surface roughness. The first electrode may define a first surface roughness and the second electrode may defines a second surface roughness, wherein the first surface roughness and second surface roughness are within the same order of rms magnitude from each other. Alternatively, the first surface roughness and second surface roughness may differ in rms magnitude from each other by at least one order of magnitude. The features may include nanometer-scale structural features having a size between 10 and 1000 nanometers and/or micrometer-scale structural features having a size between 1 and 300 micrometers.

The surface roughness may be generated via at least one of an irradiation, a mechanical abrasion, a chemical treatment, and a femtosecond pulsed laser beam applied to a surface of the at least one of the first electrode and second electrode. The surface roughness may enable a reduction in a lean flammability limit of an air/fuel mixture in a combustion chamber occupied by the spark plug. The surface roughness may also enable a reduction in power applied to the spark plug to generate a spark at the spark gap, the spark having a magnitude equivalent to a spark generated absent the surface roughness.

Further embodiments include a method of manufacturing a spark plug including a first electrode and a second electrode. Features having a surface roughness at a surface of at least one of the first electrode and second electrode are generated. The first electrode and the second electrode are then secured in a position forming a spark gap between the first and second electrode, the surface roughness being positioned in a direction of the spark gap. The features may include nanometer-scale structural features having a size between 10 and 1000 nanometers and/or micrometer-scale structural features having a size between 1 and 300 micrometers.

The surface roughness may be generated via at least one of an irradiation, a mechanical abrasion, a chemical treatment, and a femtosecond pulsed laser beam applied to a surface of the at least one of the first electrode and second electrode. The surface roughness may enable a reduction in a lean flammability limit of an air/fuel mixture in a combustion chamber occupied by the spark plug. The surface roughness may also enable a reduction in power applied to the spark plug to generate a spark at the spark gap, the spark having a magnitude equivalent to a spark generated absent the surface roughness. The features may be generated by applying a single irradiation process (rather than multiple processes of the same or different type) to a surface of the at least one of the first electrode and second electrode.

Further embodiments include a method of operating a combustion chamber. An air/fuel mixture is transferred into the combustion chamber occupied by a spark plug having first electrode and a second electrode, at least one of the first electrode and second electrode defining features having a surface roughness in a direction of a spark gap between the first electrode and a second electrode. An operation parameter is controlled as a function of the surface roughness. A voltage is applied to a terminal of the spark plug to generate a spark at the spark gap. The air/fuel mixture is then ignited via the spark.

The operation parameter may be a ratio of air to fuel of the air/fuel mixture, the air/fuel mixture having an effective lean flammability limit that is reduced as a result of the surface roughness. Alternatively or in addition, the operation parameter may be the power applied to the spark plug, the surface roughness enabling a reduction in power applied to the spark plug to generate the spark at the spark gap, the spark having a magnitude equivalent to a spark generated absent the surface roughness.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1B:
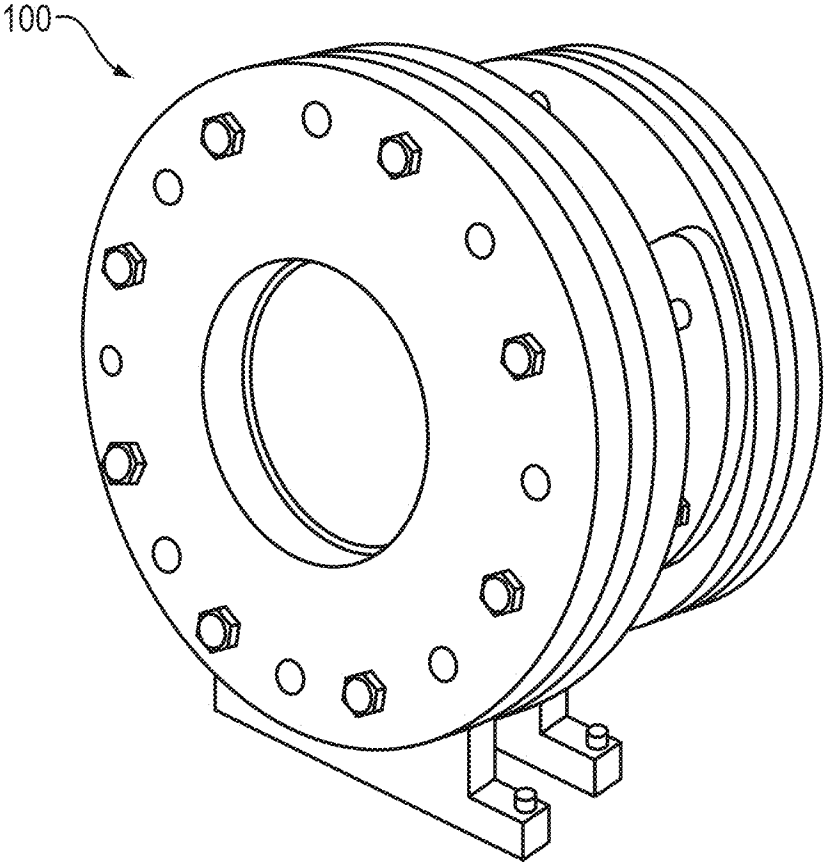
FIGS. 1A-B illustrate an optical constant volume combustion chamber in (A) Side view, (B) Isometric View.

A description of example embodiments follows.

The combustion of fossil and renewable fuels plays a critical role in the production of energy across the world. The consumption of these fuels gives rise to several concerns, including emissions, efficiency, and performance. To address these concerns, combustion systems have evolved over time, implementing a wide variety of approaches. Fuels are broadly utilized in premixed [1-4] and non-premixed combustion [5-9] using gas turbines and different forms of internal combustion (IC) engines such as spark ignition (SI) [10-12], homogeneous charge compression ignition (HCCI) [13-15], and reactivity controlled compression ignition (RCCI) [16, 17]. Gas, such as natural gas as one of the cleanest fossil fuels, is one of the main sources of energy production and electricity generation in the United States and abroad. Therefore, many studies have been done to investigate the effect of different operating conditions, such as temperature, pressure, and equivalence ratio (from lean to rich).

Ignition in a combustible mixture is defined as a heat transfer process that is initiated at a longer time in comparison with the time for an electrical breakdown of the mixture between the electrodes [18]. There are various studies about different types of ignition systems such as spark ignition (SI) [11], compression ignition (CI) [19], plasma ignition [20], and microwave-assisted ignition [21] to ignite the combustible mixture for the purpose of converting chemical energy to mechanical energy. SI engines typically utilize an external heat source (e.g. spark plug) to ignite the mixture in the cylinders. CI engines typically operate with mechanical compression to elevate the mixture temperature, which provides the required condition to ignite the mixture and produce work. Plasma ignition uses high energy plasma to deliver the minimum ignition energy needed for ignition onset of a combustible mixture.

The spark ignition is initiated with a spark using an external heat origin like a spark plug to perform as an ignitor. The composition of a spark needs an avalanche of electrons discharged between electrodes. According to Townsend theory, a large swift supply of electrons produces fresh ions and electrons that leads to a transient discharge [22]. If the discharge that happens from the cathode (positive terminal) to the anode (negative terminal) with enough energy to ionize the gas, the electrode gap is bridged to make a transition between ionized gases from a weaker to a stronger state. This transition is typically referred to as a "spark," and the area between the electrodes is typically referred to as a "spark channel." According to the earlier studies, the spark discharge is dependent on several factors, such as the electrode gap length, electrode shape, its material, gas pressure, the applied voltage and the discharge circuit [18, 22]. Embodiments of the invention add another dimension to spark discharge, namely surface roughness on one or both electrodes in the direction of the spark gap (i.e., toward an opposing electrode).

Spark-ignited engines are heavily utilized, especially in transportation systems. Therefore, it is crucial to enhance their efficiency along with reducing their emissions. Ignition systems in SI engines effectively play a key role in boosting mechanical performance and thermal efficiency. Several studies have investigated spark plug design to examine the factors affecting ignition, including spark plug gap size [23], electrode size and geometry [24], and number of ground electrodes [25]. Badawy et al [23] compared the effects of three different spark plug gaps on flame kernel growth and demonstrated that larger gap sizes lead to larger flame kernel regions. They also mentioned that the impact of the spark plug gap size is significant only at lean and stoichiometric conditions. The smaller gap sizes generate lower engine load output, along with lower in-cylinder pressure, heat release rate, and flame speed. Bane, Ziegler, and Shepherd [24] studied the effects of three different electrode geometries on flame onset, spark kernel, and flame formation. Spark kernel is effectively influenced by the electrode geometry, which generally leads to a spherical structure in the vicinity of the electrode surfaces and cylindrical near the center of spark gap.

Lean combustion has gained a clear interest in several applications due to its significant benefits on fuel economy, environment pollution, and engine performance. Lean conditions have a potential capability to reduce emissions, increase fuel efficiency [26], improve thermal efficiency [27], and mitigate engine knock [28]. A lean mixture is provided with higher oxygen concentration compared to a stoichiometric mixture. This leads engines to have excess oxygen to burn an amount of fuel. Theoretically, since the fuel is consumed completely at lean conditions, hydrocarbon emissions are reduced. Lean conditions also play a key role with respect to fuel economy. The ideal thermal efficiency of an IC engine (Equation 1), which is strongly dependent on the ratio of the specific heats of the mixture, can be boosted in leaner conditions due to the higher ratios of the specific heats for the leaner mixture. This ratio for the mixture would be larger while increasing the excess air.

$$\eta = 1 - \left(\frac{1}{r^{(\gamma-1)}}\right) \tag{1}$$

Traditional spark ignition engines operate at a stoichiometric ratio of fuel and air, meaning that fuel is provided to consume all available oxygen in the air, so that the three-way catalyst can operate properly. However, operating an internal combustion (IC) engine at lean mixtures can lead to increased efficiencies and lower emissions. For any given spark plug, engine configuration, and fuel mixture, there is a lower limit that represents the leanest mixture that can be ignited by the spark plug. Other approaches to igniting fuel/air mixtures, especially under lean conditions, include laser ignition, the combination of microwaves in addition to the spark event, and corona spark plugs. Each of these approaches requires significant modifications to the existing ignition system and additional hardware. In contrast, embodiments of the invention disclosed herein, and alternative embodiments thereof, operate within the construct of traditional SI engines and do not require hardware modifications outside of changing the spark plug from one with electrodes having a smooth surface to one that has electrode(s) with a rough surface, as described hereinbelow. Furthermore, the macro-scale geometry of the spark plug remains unaltered. Further, embodiments of the invention can be applied to spark plugs of differing geometries.

Several studies have investigated spark plug design to examine factors affecting ignition, including spark plug gap size, electrode size and geometry, and number of ground electrodes. Embodiments of the invention disclosed herein are directed to a factor relating to discharge: surface roughness and morphology.

Embodiments of the invention have modified surface properties of spark plug electrodes, resulting in at least two potential benefits:

a) enabling ignition at lower fuel concentrations, also known as extending the lean flammability limit. This enables operation in regimes that can increase efficiency and decrease emissions; and
b) providing a similar quality of spark at lower delivered electrical powers. This extends the lifetime of the spark plugs, which is one of the major concerns of engine manufacturers.

An example technique used for modifying the electrode surface employs ultra-short pulse lasers. There are several different methods for imprinting or modifying a metal's surface; the underlying principles of the invention disclosed herein extend to other methods of surface modification.

Embodiments improve an ability of traditional spark plugs to operate at leaner conditions (increasing efficiency, decreasing emissions) or to operate at lower electrical power levels (increasing lifetimes).

Embodiments are applicable to all engines (and apparatuses) that use spark ignition.

In measuring surface roughness, a Wyko NT2000 Optical Profiler was used to measure a root mean square (RMS) surface roughness for a raw spark plug and an exposed (i.e., "roughened") spark plug that were 3.37 μm and 4.93 μm, respectively. This indicates a 46.3% increase in surface roughness due to a roughening procedure employed to roughen the electrode surface.

A surface roughness above 1.25× the original surface roughness may have a measurable effect on performance and above 10× might yield diminishing results. Further testing and analysis may support more particular results.

A definition of surface roughness as used herein is the following: surface roughness is quantified by measured deviations in a direction normal to a surface. Large deviations indicate a rough surface, while small deviations represent a smooth surface. Typically, these deviations occur at short wavelengths and high frequencies. Deviations can be ordered, patterned, or random—all of which contribute to the surface roughness. As currently understood, the driving force behind performance is an increase in surface area driven by an increase in surface roughness. Surface roughness with respect to electrode(s) of the spark plug are in the order of nanometers or micrometers.

To understand the effects of the nano- or microstructure features defined by a spark plug electrode, experiments have been conducted with a high-speed Z-type Schlieren system to investigate the effect of spark plug electrode surface roughness as a potential avenue to extend the lean flammability limit of natural gas. A constant volume combustion chamber (CVCC) filled by a premixed methane-air mixture with different lean equivalence ratios was used to study the electrode surface roughness on spark ignition. An electrode surface modification is implemented using femtosecond laser pulses to increase the surface roughness. Then, the effect of raw spark plug with no surface modification is compared to the nanostructured spark plug to assess the onset of ignition and flame kernel behavior.

Methods

Experimental Setup

Figure 1A:
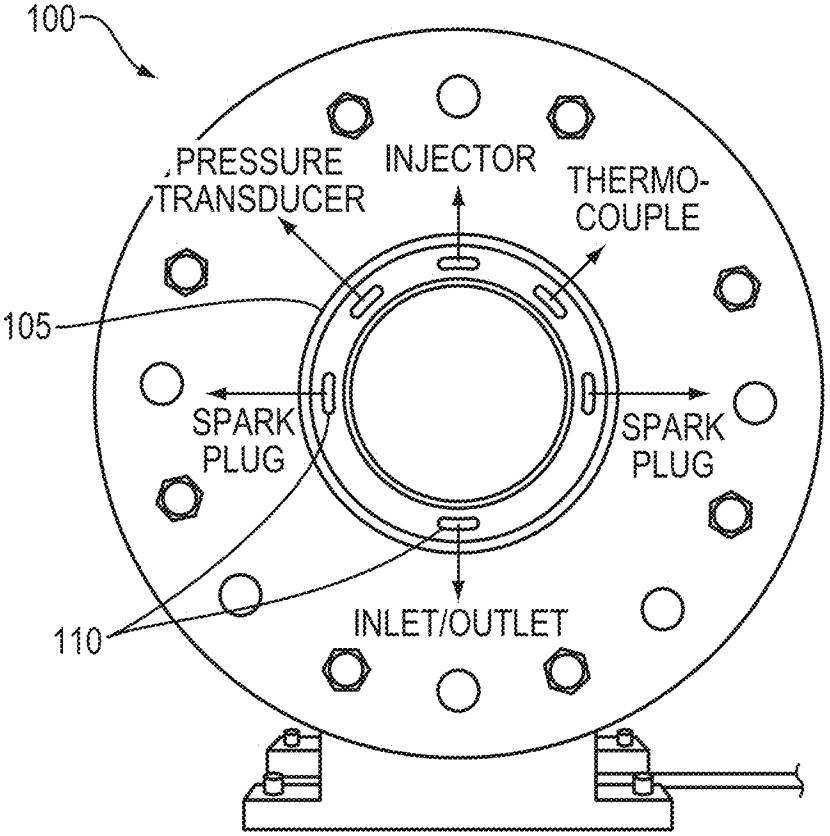

FIGS. 1A-B illustrate an optical constant volume combustion chamber (CVCC) 100 in which example embodiments may be implemented. The CVCC 100 is shown in side view (FIG. 1A) and isometric view (FIG. 1B). The CVCC 100 includes a cylindrical inner chamber 105, and a number of channels 105 may occupy a wall of the inner chamber to accommodate spark plugs, an injector, a thermocouple, and inlet/outlet ports.

Figure 1C:
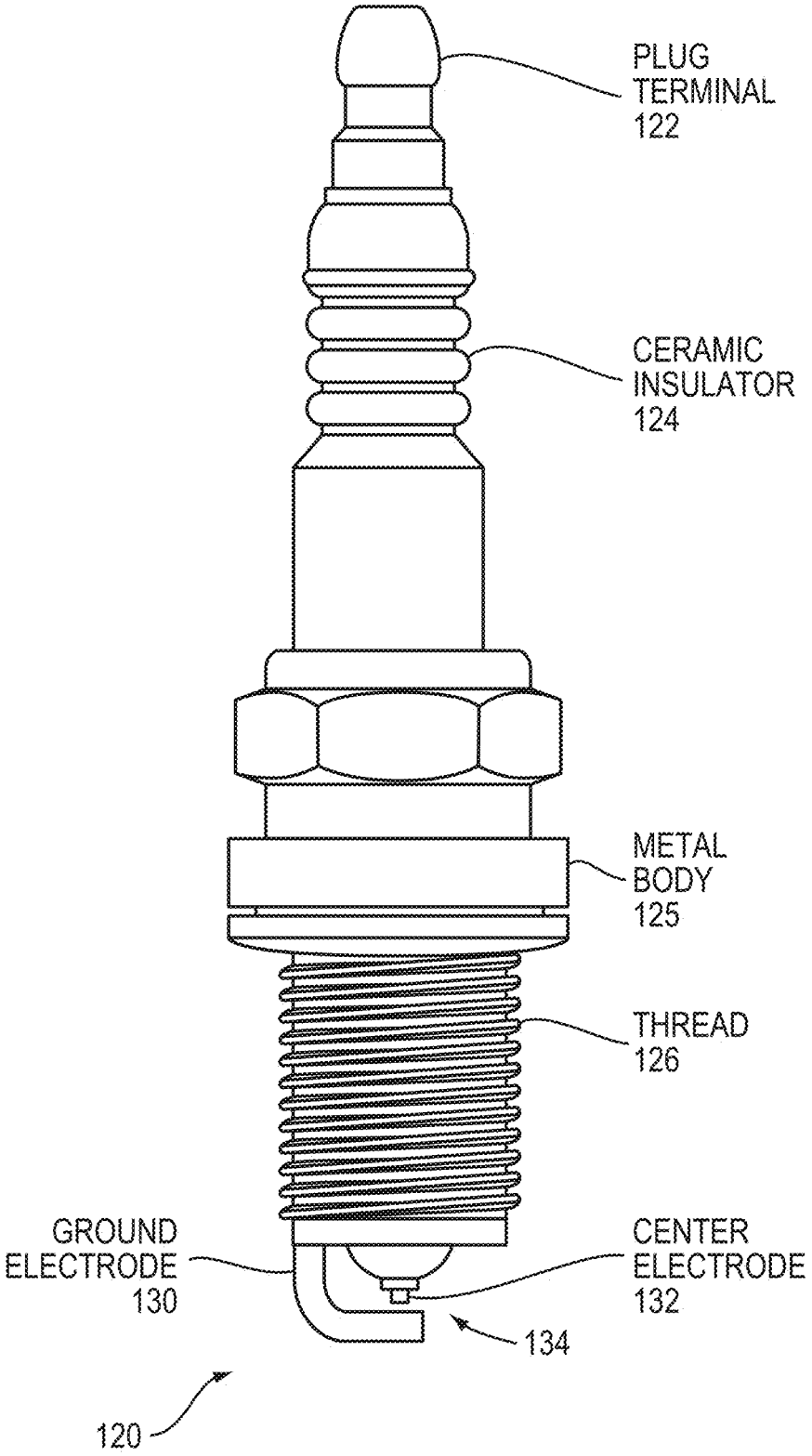
FIG. 1C is a diagram of a spark plug that may be used inside the combustion chamber to ignite an air-fuel mixture.

FIG. 1C illustrates a spark plug 120 in an example embodiment. The spark plug 120 may be implemented in a combustion chamber, such as the optical CVCC 100 or the combustion chamber of an internal combustion engine, to ignite an air-fuel mixture. The spark plug 120 may include a plug terminal 122 for connection to a current source, a ceramic insulator 124, a metal body 125, and a threaded extension 126 for secure placement in a threaded channel of a combustion chamber. At an end opposite the plug terminal 122, a ground electrode 130 (e.g., anode) and a center electrode 132 (e.g., cathode) may extend from the threaded extension 126, and may be separated by a spark gap 134. A current applied to the electrodes 130, 132 (via the plug terminal 122) generates a spark at the spark gap 134, thereby igniting an air-fuel mixture within the combustion chamber. In example embodiments, the ground electrode 130 and/or the center electrode 132 may be processed as described herein to exhibit surface roughness in a direction of the spark gap 134. The ground electrode 130 and/or the center electrode 132 may undergo different processes (e.g., laser ablation) to create the surface roughness, thereby resulting in multiple sets of surface roughness features at one or both of the electrodes 130, 132. Those surface roughness features may differ in scale. For example, the center electrode 132 may be processed under a first process to create micrometer-scale features and a second process to create nanometer-scale features. In contrast, the ground electrode 130 may be processed under a single process to create nanometer-scale features.

Experiments may be conducted in the optical CVCC 100 to visually study effect of spark plug electrode surface roughness on flame kernel growth, flame morphology and its instability. In one embodiment, the optical CVCC 100 may be a cylindrical chamber with an internal diameter and length of 140 mm. The chamber 100 may be built from stainless steel and equipped with two flanges at both ends to support two 50.8 mm thick fused quartz windows. The cylindrical optical CVCC 100 and flanges may be sealed to the quartz windows with nitrile rubber elastomer O-rings. The chamber 105 may contain a high precision piezoelectric pressure transducer (KISTLER 601CAA), a thermocouple (OMEGA KMTXL-062G-6), a gas inlet/outlet, and the spark plug 120.

Figure 2:
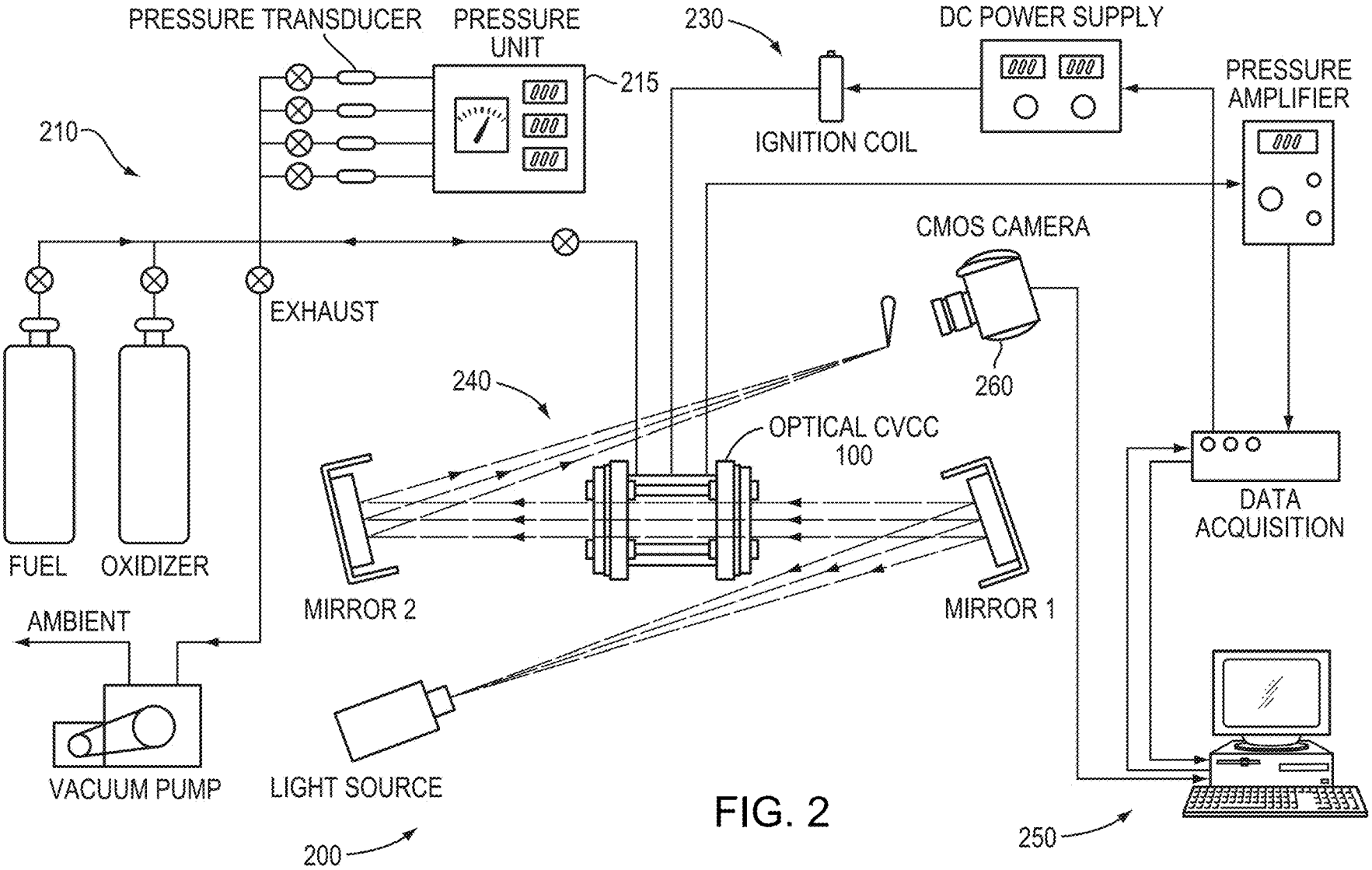
FIG. 2 is a schematic diagram of experimental systems.

FIG. 2 is a schematic diagram of an experimental ensemble 200 to observe operation of the optical CVCC 100.

The ensemble 200 may include a gas delivery system 210, pressure control units 215, ignition system 230, Z-type Schlieren arrangement 240 (e.g., light source and mirrors configured to direct light through the CVCC 100), and data acquisition system 250 (e.g., a workstation and control interface). In order to observe the flame development, the Z-type Schlieren ensemble 240 may be employed using a high-speed high-resolution CMOS camera 260 (e.g., Edgertronic SC2+), two concave mirrors, a light source with a pin hole, and a knife edge. The high-speed CMOS camera 260 may have a capture rate of up to 31,191 frames per second, and the capture rate and shutter speed can be optimized depending on the flame burning speed and the brightness of the flame front. In this setup, the light source and the knife edge may be supported at the focal length of the mirrors, (e.g., 1524 mm).

A wide range of lean equivalence ratios was performed to study lean flammability limit (LFL) of methane (as the primary component of natural gas) for both spark plugs with different surface roughness. Initial pressure and temperature for all cases were kept constant on 1 bar and 25 degrees Celsius, respectively. The methane-air mixture is ignited in the CVCC 100 by a conventional ignition, operating with a coil, a DC power supply, and a capacitor. The ignition system utilizes a primary and secondary circuit to provide high voltage for the spark plug electrode that enables the spark plug to ionize the gaseous mixture in a spark channel created between the spark plug electrodes. If this voltage is high enough to pass the breakdown voltage, the spark gap functions as a bridge with Townsend avalanche of electrons discharging from cathode (positive terminal) to anode (negative terminal) [22].

Nano-/Micro-Morphology Modifications

There are several methods to fabricate nanometer-scale and micrometer-scale structures on solid substrates. One example technique is to make these structures on metallic surfaces employs ultra-short pulse lasers [29]. The femtosecond pulsed laser irradiates electromagnetic pulses in a very short time duration on the order of a femtosecond. The fabrication procedure exposes the solid surface to the femtosecond laser beam by scanning the substrate line by line across the surface. These pulses have the potential to irreversibly change the surface of metals by creating either nanostructures or microstructures on their substrate. Due to the scanning, the surface temperature possibly passes the melting point, and silicone oil is applied on the surface of the solid to decrease the possibility of damage and prevent surface oxidation. Irradiating the electrode surface with femtosecond laser pulses above the ablation threshold develops the ripple substrates on the electrode surface. This approach is a roughness-enhanced method, which effectively roughens electrode surface and adds conducting protrusions at the surface.

The process was carried out on spark plug (BOSCH WR8LC+) electrodes by bending its ground electrode to make the electrode accessible for the laser beams. We then bend the ground electrode back to its primary situation keeping the electrode gap constant that is 1 mm. To observe the surface modification with femtosecond laser pulses, a destructive testing method was required. The electrodes were removed from the spark plugs to make them fitted for material characterization devices using a Scanning Electron Microscope (SEM).

Figure 3:
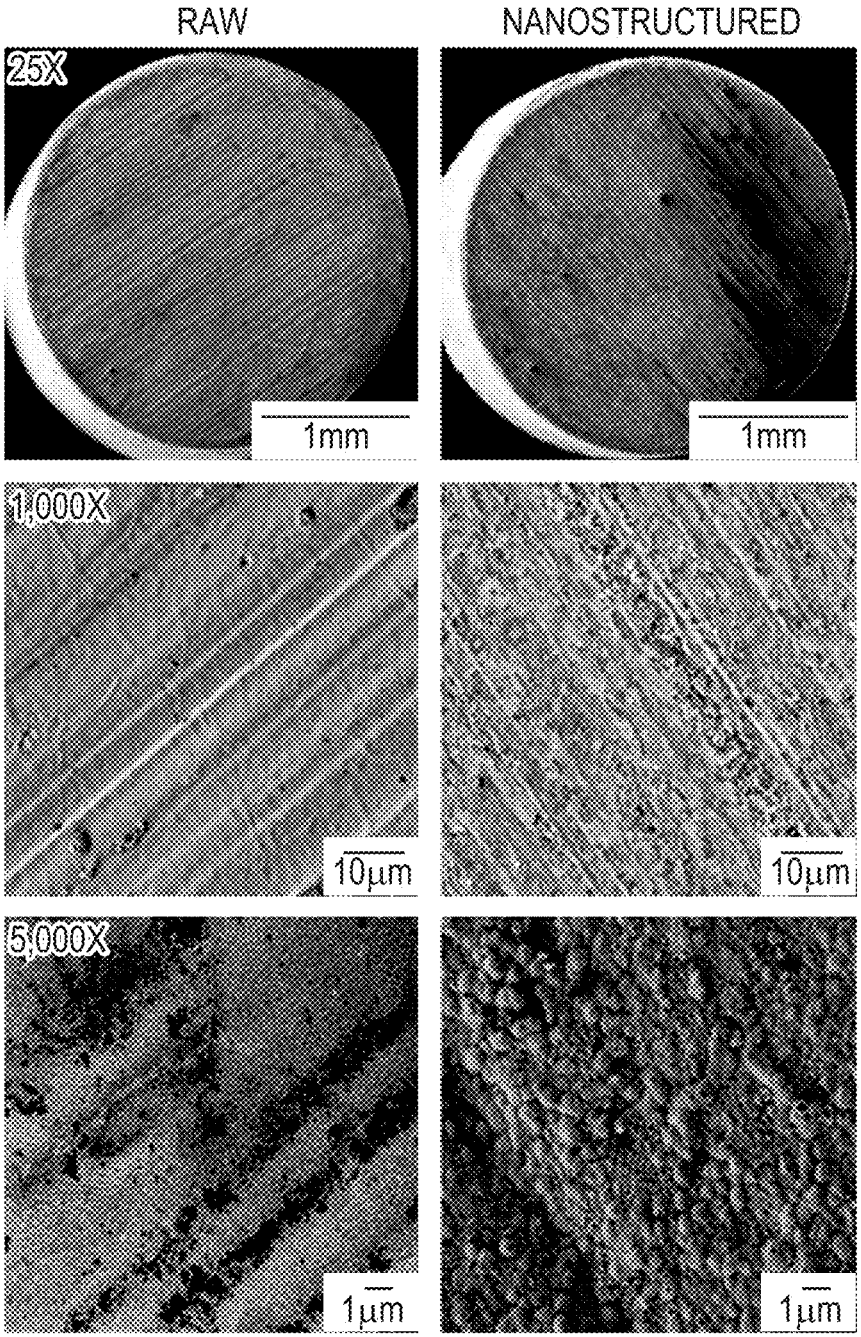
FIG. 3 is a set of multiple scanning Electron Microscope images of raw and nanostructured electrode surfaces under different magnifications.

FIG. 3 is a set of multiple scanning Electron Microscope images 300 of raw (left column) and nanostructured (right column) electrode surfaces under different magnifications (e.g. 25×, 1,000×, 5,000×). The images 300 illustrate the effect of laser spot scanning on forming the rippled nano-/micro-structures on the surface of the electrode. A Wyko NT2000 Optical Profiler has been used to measure the root mean square (RMS) surface roughness for the raw spark plug and exposed spark plug that were 3.37 μm and 4.93 μm, respectively. This indicates a 46.3% increase in surface roughness due to the fabrication procedure. In further embodiments, electrodes of a spark plug may have a surface roughness that is composed of structures in the ranges of 1-300 micrometers, 1-3 micrometers, 10-100 nanometers, and/or 100-1000 nanometers. Nanometer-scale features, in particular, may significantly increase the surface area of the electrode relative to larger features. As described below, micrometer and nanometer-scale features at the center and/or ground electrode enable a spark plug to achieve ignition and leaner fuel mixtures, thereby enabling an engine to operate using a leaner mixture of fuel.

Results and Discussion

Surface Roughness and Breakdown Voltage

According to the earlier studies, the correlation between electrode surface roughness and breakdown voltage has been theoretically and experimentally quantified [30, 31]. Sato et al. studied an electrode made of copper, the same as the electrode material of the spark plugs performed in this study. Equation 2 describes a simple general relationship between breakdown voltage and electrode surface roughness [31]:

$$V_{50}=AR^{-n}, \tag{2}$$

where $V_{50}$ is 50% breakdown voltage, R is defined as centerline average roughness (ISO 468-1982 and ISO 4284/1-1984), and A and n are constants formulated as a function of gap length.

This formula indicates that increasing electrode surface roughness exponentially decreases the breakdown voltage. Therefore, nanostructures produced by femtosecond laser pulses potentially decrease the breakdown voltage and lessens the onset electrical field strength [30]. This may imply that the higher roughness provides a lower minimum ignition energy that is required to ignite the gaseous mixture.

While Equation (2) is a generalized equation used to understand the discharge between two flat plates, it has not been used to characterize spark plug performance. Our application of the formula is to highlight the underlying role of surface roughness on discharge events in general. It follows that a decrease in breakdown voltage could yield a lower minimum ignition energy required to ignite the gaseous mixture.

Characterization of the surface properties as presented above has relied on the RMS surface roughness as a quantitative measure. However, different surface medication approaches and procedures can produce surfaces with varied shapes, patterns, and presentations. For example, the surface may be jagged (like mountains) or undulating (like a sine wave)—both of which would have a RMS surface roughness. However, the sharpness—or Kurtosis—also plays a role in the electrical discharge. Prior research, largely on macroscopic shapes, has shown that sharper features lead to lower breakdown voltages. Therefore, by modifying the surface to increase both the surface roughness and the sharpness of surface features, can also potentially provide improved spark performance.

Lean Flammability Limit

The impact of electrode surface roughness on the lean flammability limit (LFL) was studied using a methane-air mixture ignited by both spark plugs. The experiment has been repeated four times for each equivalence ratio by each spark plugs to study its accuracy and repeatability. The uncertainty of equivalence ratio is ±0.6% and of maximum pressure is ±0.1 bar. The results indicate that roughening the electrode surface plays a role in decreasing the LFL. According to the previous studies, the LFL of methane-air mixture has been reported near 5% [32, 33].

Turning again to FIG. 2, the gas delivery system 210, pressure control units 215, ignition system 230 and/or other control systems of the ensemble 200, or the control system of an internal combustion engine, may control an operational parameter as a function of the surface roughness of the spark plug. For example, a controller such as the gas delivery system 210 may reduce the ratio of fuel to air of the air/fuel mixture, wherein the air/fuel mixture exhibits an effective lean flammability limit that is reduced as a result of the surface roughness, thereby enabling the reduction. In a further example, a controller such as the ignition system 230 may reduce the power applied to the spark plug, wherein the surface roughness enables a reduction in power applied to the spark plug to generate the spark without reducing the magnitude of the spark.

Figure 4:
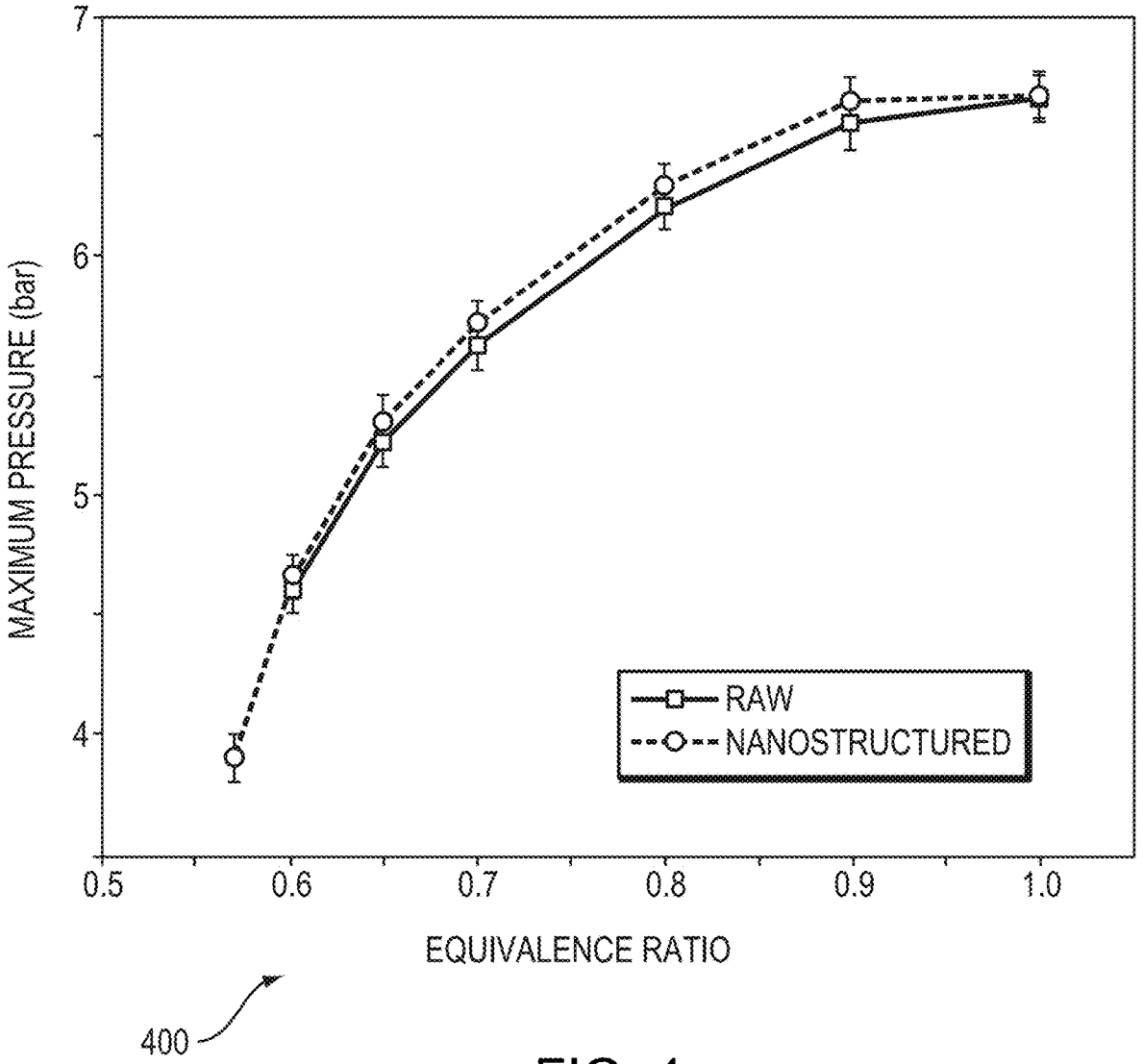
FIG. 4 is a graph illustrating maximum pressure of combustion along different equivalence ratios for spark plugs with electrodes of raw versus nanostructure features.

FIG. 4 is a graph 400 illustrating maximum pressure of premixed methane-air combustion along different equivalence ratios for spark plugs with electrodes of raw versus nanostructure features. These results indicate that the nanostructured spark plugs have a lower LFL compared to the raw spark plug. In addition, its minimum LFL reaches 5.9% (equivalence ratio is 0.57), however, the purity of methane gas is an important factor on flammability limit that needs to be considered. This enhancement on lean flammability limit may be due to a lower minimum ignition energy and higher heat transfer, both of which contribute to ignition onset [18]. In further studies, high-precision thermistor sensors can be employed to accurately determine the temperature at each electrode.

Image Analysis

Figure 5:
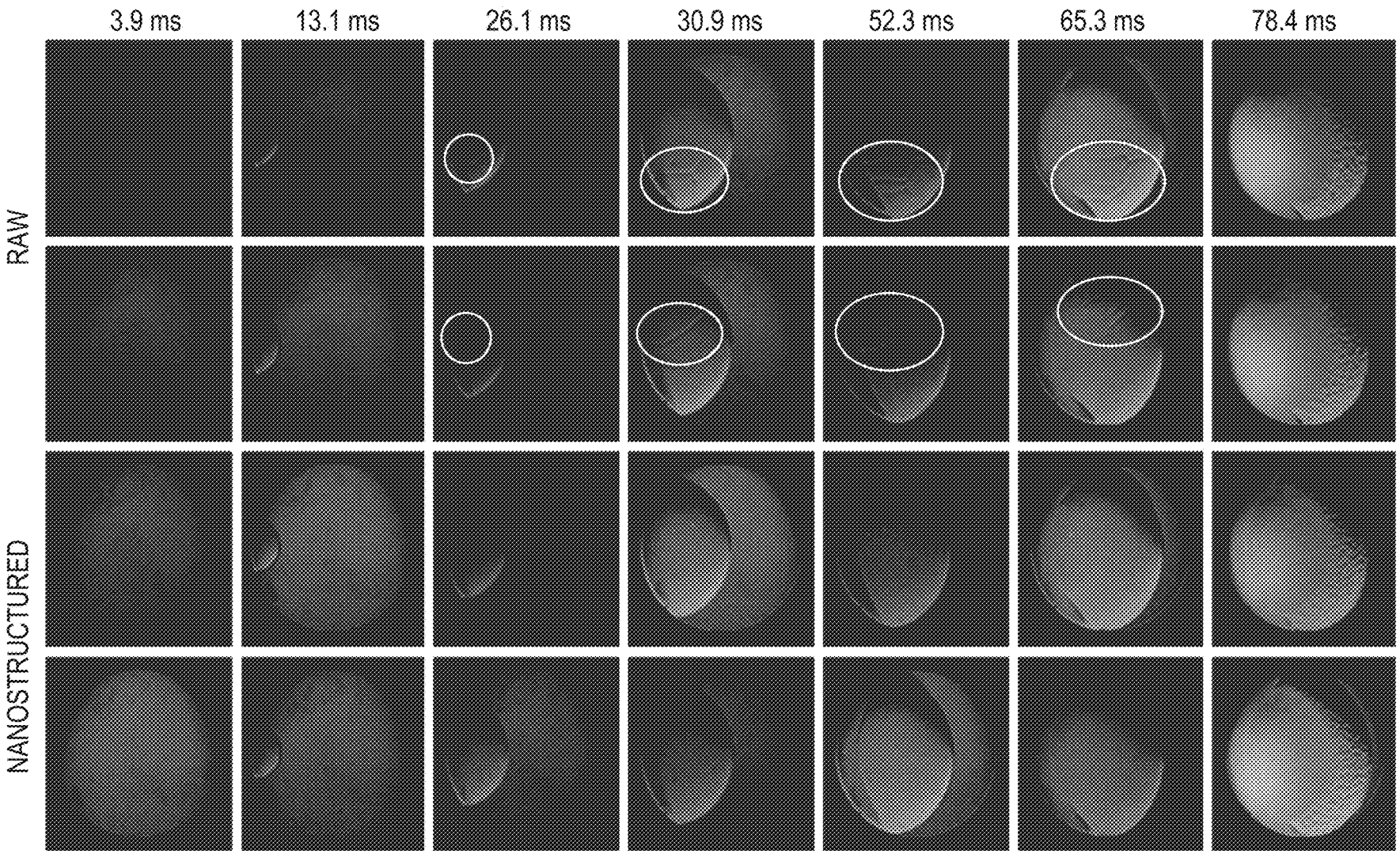
FIG. 5 is a set of images of flame kernel development in the premixed combustion of methane-air mixture for several time frames for spark plugs with electrodes of raw versus nanostructure features.

FIG. 5 is a set of images 500 illustrating flame kernel development of the spark-ignited premixed combustion of methane-air mixture for several time frames (between 3.9 ms and 78.4 ms post-ignition, as shown in the top row) for spark plugs with electrodes of raw (top two rows) versus nanostructure features (bottom two rows). The example images 500 were captured by an optical CVCC such as the optical CVCC 100 described above. The images 500 visually display that the flame development is almost identical for both spark plugs with different electrode surface roughnesses. According to this preliminary study, the major difference between them is related to flame stability, which is seen in the middle frames. As shown by the circled image portions, in the case of the raw spark plug, the flame front becomes instable, and cellular flames appear with different patterns. On the other hand, in case of the nanostructured spark plug, the flame front propagates through the mixture much more smoothly in the laminar state and is much stable with fewer flame cells, possibly due to delivering a lower electric field strength from the nanostructured spark plug. This result indicates that manipulating the electrode surface roughness may lead to stable flames compared to the smoother electrode surface.

Apart from the irregular flame patterns seen in the middle frames by ignition of the raw spark plug, both flame fronts became unstable near the walls as expected. This wrinkled flame morphology is due to turbulence, which caused by the interface between the burned gas and the unburned gas happened at a very short time scale, distorting the laminar flame front [34]. The laminar flame thickness is smaller or equal to Kolmogorov microscale in the wrinkled flame region.

Figure 6:
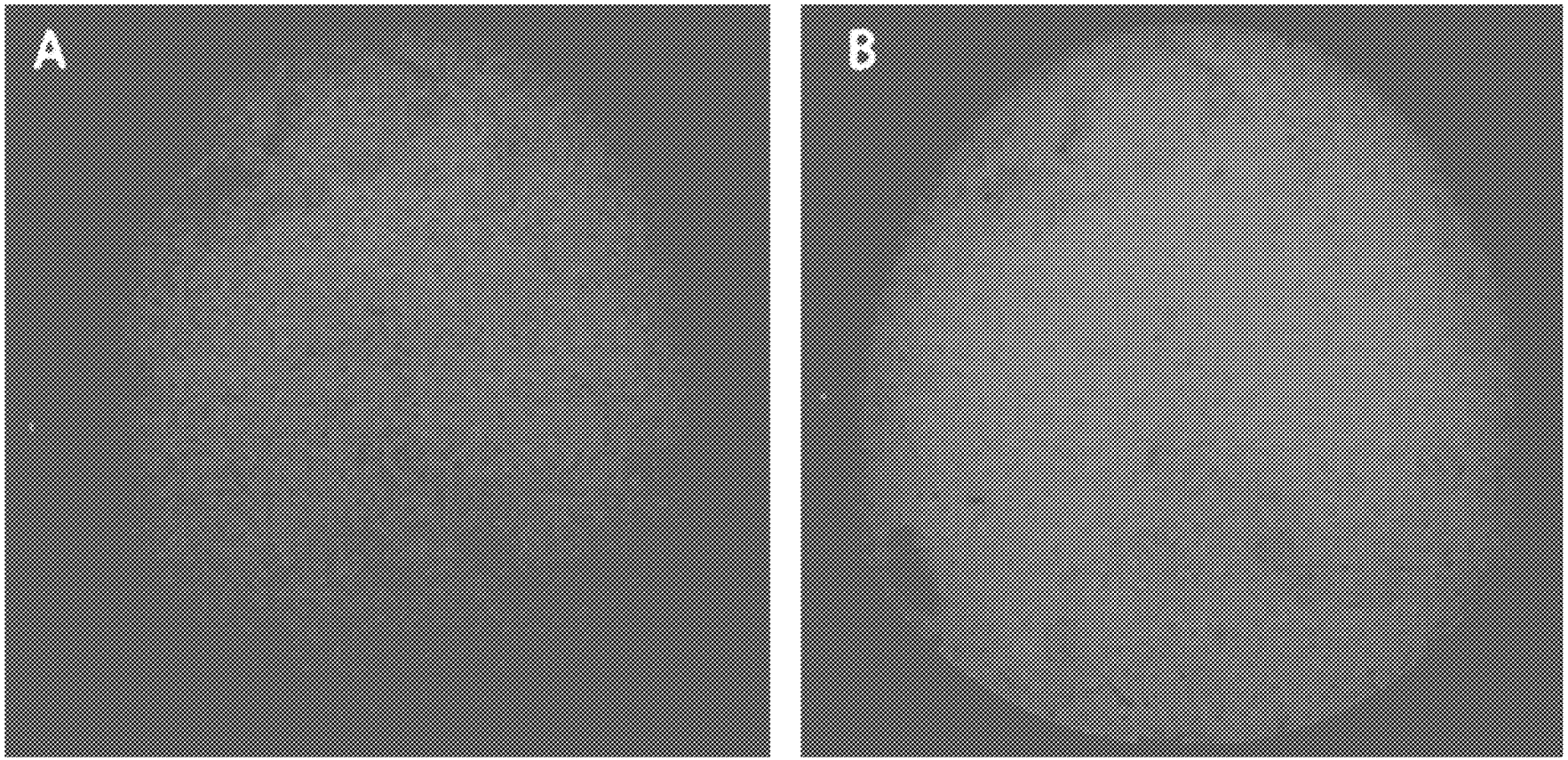
FIG. 6 is a set of images of flame kernel growth in early stage of premixed combustion.

FIG. 6 is a set of images 601, 602 of flame kernel growth in early stage of premixed combustion at time frame of 3.9 ms for a raw spark plug (601) and a nanostructured spark plug (602) in an example embodiment. If the early stage of flame development is carefully examined, a clear distinction on flame kernel growth between both raw and nanostructured spark plugs can be seen. In the case of the raw spark plug, the flame tends to develop in forward and lateral directions concurrently. However, the flame front in the nanostructured spark plug develops with higher growth rate in forward direction than lateral direction. As mentioned previously, the breakdown voltage in the nanostructured spark plug is lower than that of the raw one. This leads to a lower electric field strength in the nanostructured spark plug, which presents a lower energy for flame propagation in each direction into the combustible mixture. This may account for the lower growth rate in lateral direction compared to that in the nanostructured spark plug. Moreover, this may imply that the flame burning speed of flame front in early stage of propagation in forward direction for both spark plugs are relatively similar; however, the flame speed of the raw spark plug in lateral direction is higher than that of the nanostructured spark plugs.

Pressure and Temperature

Figure 7:
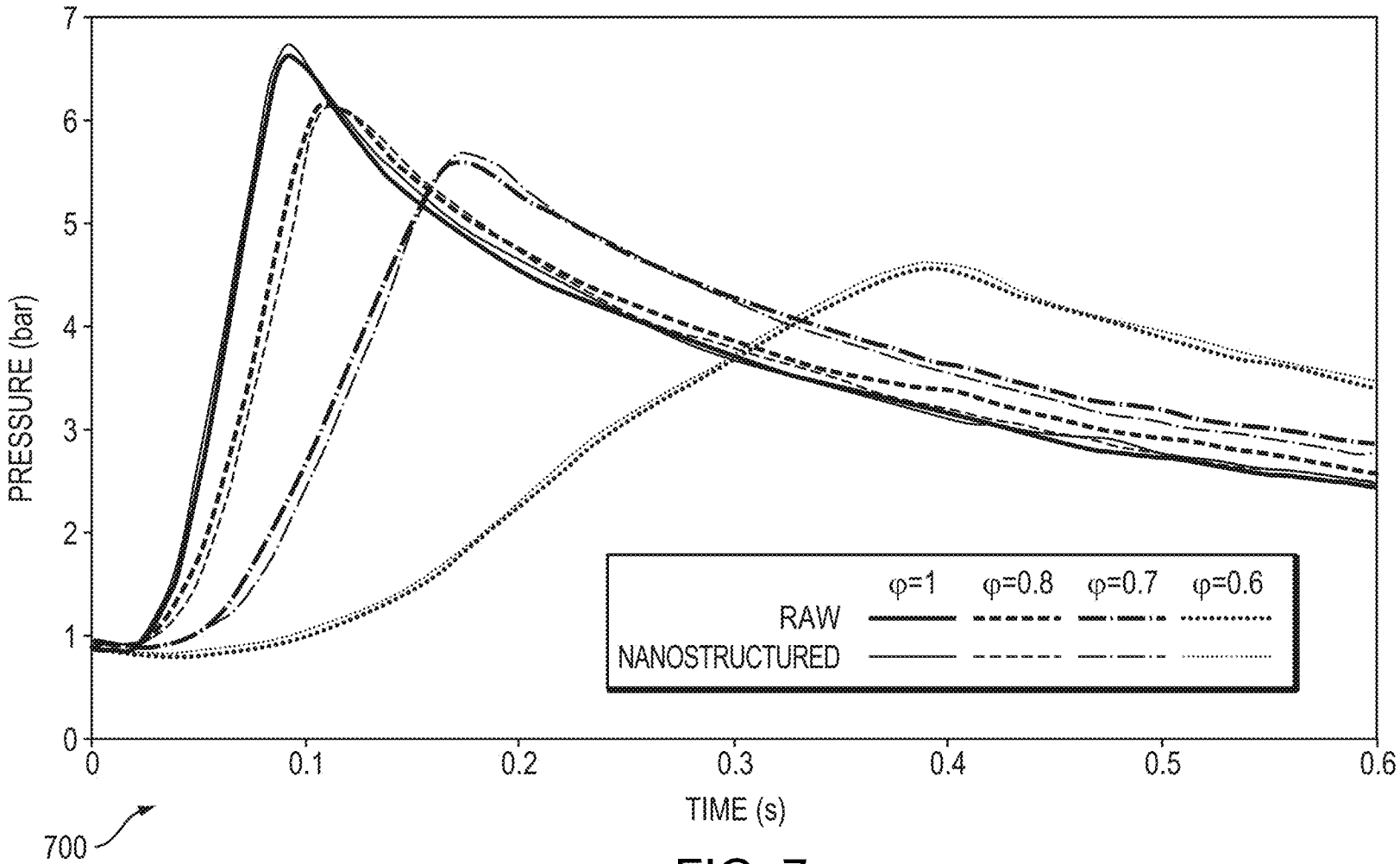
FIG. 7 is a graph with multiple curves providing a comparison of pressure rise during the flame propagation for both raw and nanostructured spark plugs along an equivalence ratio.

FIG. 7 is a graph 700 comparing pressure rise during the flame propagation for both raw and nanostructured spark plugs along an equivalence ratio. The graph 700 shows the pressure history of methane-air premixed spark-ignited combustion for a range of lean equivalence ratio using each spark plug. The empirical results demonstrate that the lower equivalence ratios drive pressure to a lower range. In addition, the maximum pressure for the nanostructured spark plug is higher than that of the raw spark plug for all equivalence ratios. Maximum uncertainty of the pressure measurements is ±0.1 bar.

An important portion of combustion process in internal combustion engines is related to the unburned gas temperature. The unburned gas temperature range of methane-air mixture is calculated with an assumption of an isentropic process, using the Equation 3. The indices 1 and 2 represent the primary and secondary thermodynamic states, respectively [35].

$$\frac{T_2}{T_1} = \left(\frac{P_2}{P_1}\right)^{\frac{\gamma-1}{\gamma}} \tag{3}$$

Figure 8:
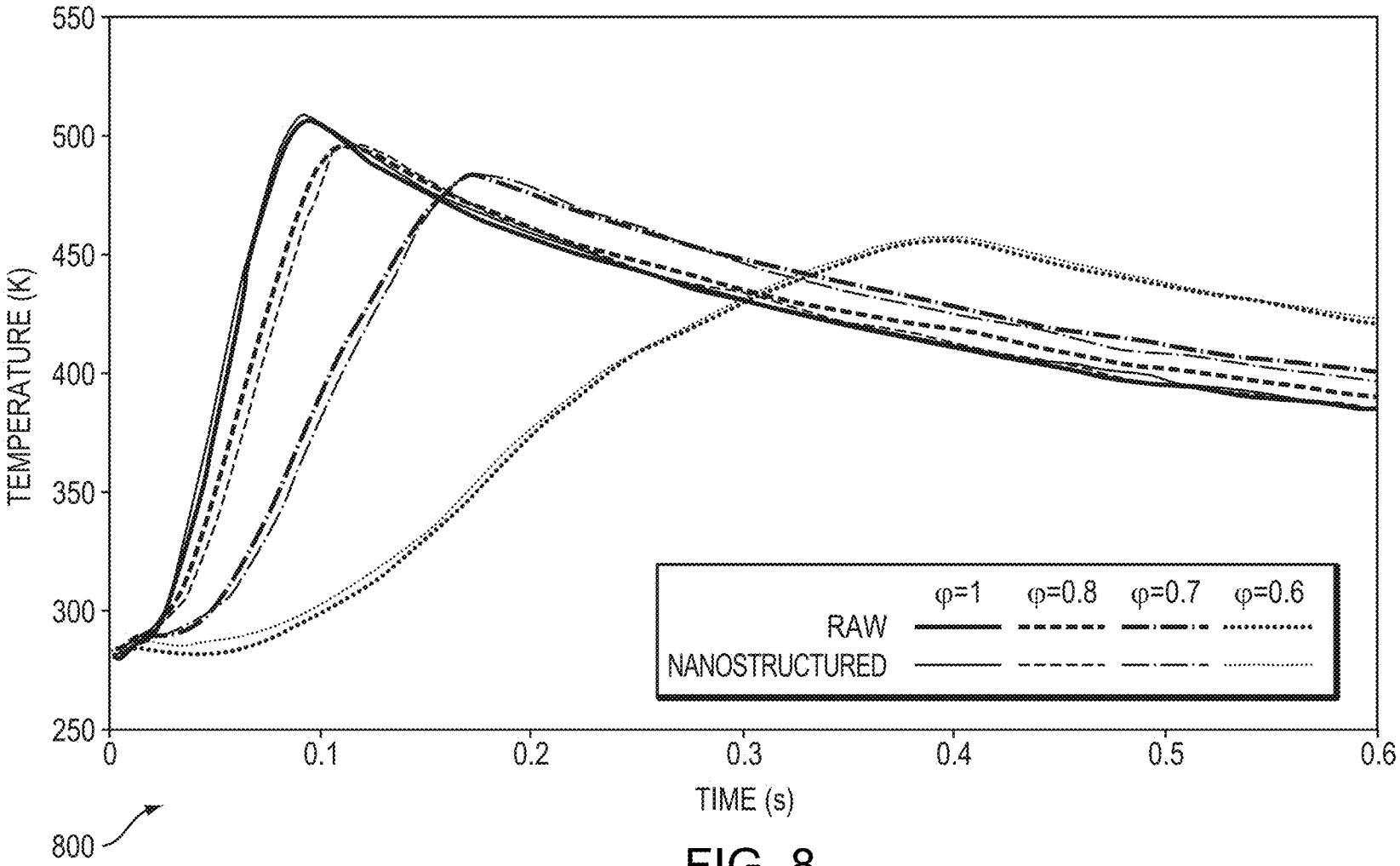
FIG. 8 is a graph with multiple curves providing a comparison of temperature of unburnt mixture for both raw and nanostructured spark plugs along an equivalence ratio.

FIG. 8 is a graph 800 providing a comparison of temperature over time of unburned mixture for both raw and nanostructured spark plugs in a range of lean equivalence ratios (e.g., 0.6-1.0).

Figure 9:
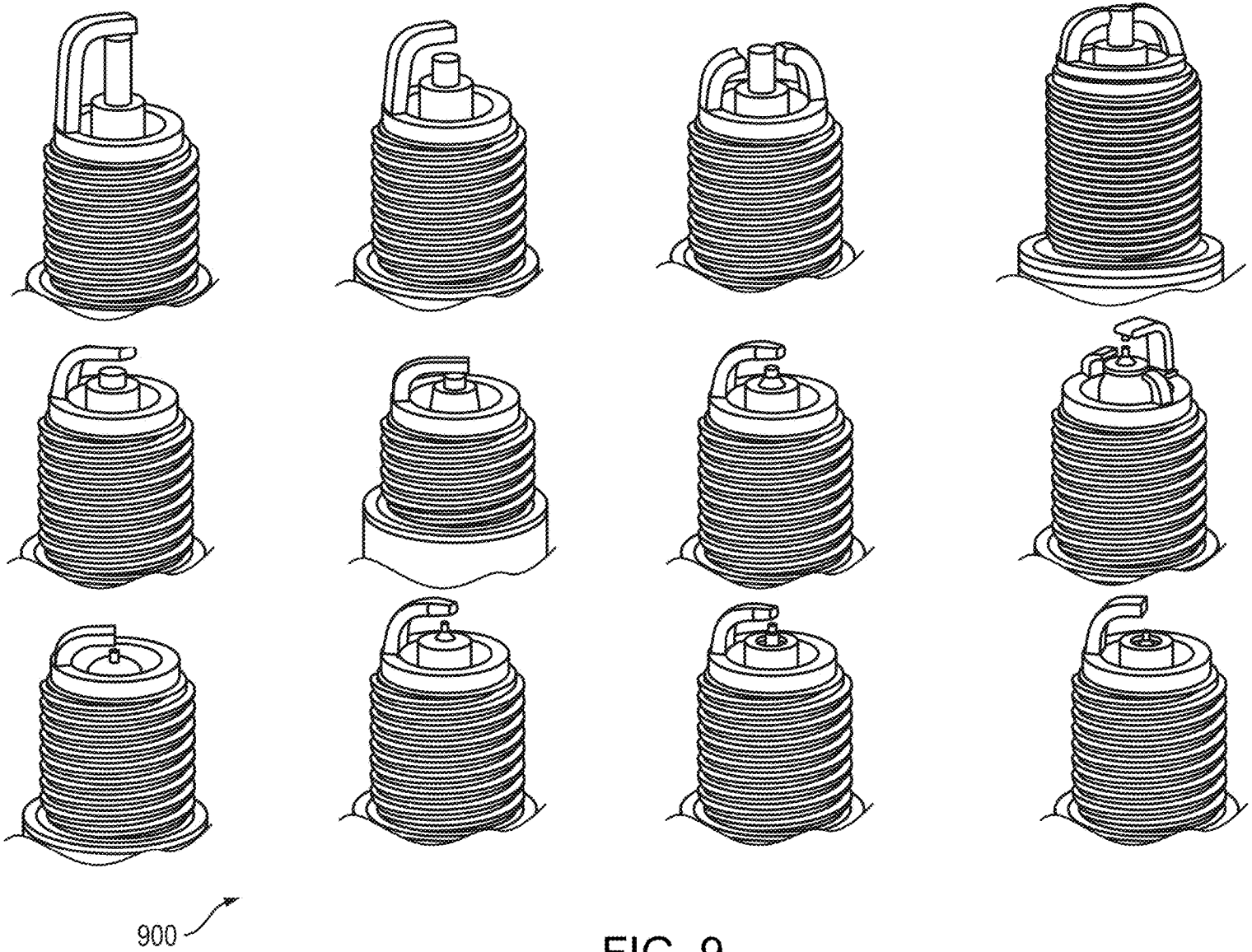
FIG. 9 is a diagram of a variety of spark plugs that may have at least one electrode that defines features having a surface roughness in a direction of a spark gap.

FIG. 9 is a collection of images 900 illustrating of a variety of spark plugs that may have at least one electrode that defines features having a surface roughness in a direction of a spark gap as described above.

CONCLUSIONS

Two spark plugs with different electrode surface roughnesses were compared to investigate their effect on the flame kernel development and the lean flammability limit. The experiments indicate that the nanostructured spark plug extended the lean flammability limit of methane. The nanostructured spark plug has lower breakdown voltage and a lower electric field strength. This leads to a smaller flame growth rate in lateral direction in the early stage of ignition onset in comparison with the raw spark plug. The flame then develops outward through the chamber in a similar growth rate visually; however, the flame front may exhibit higher instability in the raw spark plug when compared to the nanostructured spark plug.

NOMENCLATURE

| | | |
|---|---|---|
| a) | A | Constant |
| b) | n | Constant |
| c) | P | Pressure |
| d) | r | Compression ratio |
| e) | R | Centerline average roughness |
| f) | T | Temperature |
| g) | $V_{50}$ | 50% breakdown voltage |
| h) | $\gamma$ | Specific heat ratio |
| i) | $\eta$ | Thermal efficiency |

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

REFERENCES

[1] O. Askari, Z. Wang, K. Vien, M. Sirio, and H. Metghalchi, "On the flame stability and laminar burning speeds of syngas/O 2/He premixed flame," *Fuel, vol.* 190, pp. 90-103, 2017.

[2] J. Song, Z. Huang, X. Qiao, and W. Wang, "Performance of a controllable premixed combustion engine fueled with dimethyl ether," *Energy conversion and management, vol.* 45, no. 13-14, pp. 2223-2232, 2004.

[3] M. Morovatiyan, M. Shahsavan, and J. H. Mack, "Development of a Constant Volume Combustion Chamber for Material Synthesis," in *Eastern States Section of the Combustion Institute Spring Technical Meeting*, State College, Pa., 2018.

[4] K. Seshadri et al., "Experimental and kinetic modeling study of combustion of JP-8, its surrogates and components in laminar premixed flows," *Combustion Theory and Modelling*, vol. 15, no. 4, pp. 569-583, 2011.

[5] M. Shahsavan, M. Morovatiyan, and J. H. Mack, "A numerical investigation of hydrogen injection into noble gas working fluids," *International Journal of Hydrogen Energy*, vol. 43, no. 29, pp. 13575-13582, 2018.

[6] M. Shahsavan and J. H. Mack, "Mixedness Measurement in Gaseous Jet Injection," in *American Society for Engineering Education Northeast Section* (*ASEE-NE*) *Annual Conference*, Lowell, Mass., 2017.

[7] A. Holley, Y. Dong, M. Andac, F. Egolfopoulos, and T. Edwards, "Ignition and extinction of non-premixed flames of single-component liquid hydrocarbons, jet fuels, and their surrogates," *Proceedings of the Combustion Institute*, vol. 31, no. 1, pp. 1205-1213, 2007.

[8] M. Shahsavan and J. H. Mack, "The Effect of Heavy Working Fluids on Hydrogen Combustion," in 10*th US National Combustion Meeting*, College Park, M D, 2017.

[9] M. Shahsavan, M. Morovatiyan, and J. H. Mack, "The Influence of Mixedness on Ignition for Hydrogen Direct Injection in a Constant Volume Combustion Chamber," in *Eastern States Section of the Combustion Institute Spring Technical Meeting*, State College, Pa., 2018.

[10] S. Liu, E. R. C. Clemente, T. Hu, and Y. Wei, "Study of spark ignition engine fueled with methanol/gasoline fuel blends," *Applied Thermal Engineering*, vol. 27, no. 11-12, pp. 1904-1910, 2007.

[11] D. Johnson, M. Darzi, C. Ulishney, M. Bade, and N. Zamani, "Methods to Improve Combustion Stability, Efficiency, and Power Density of a Small, Port-Injected, Spark-Ignited, Two-Stroke Natural Gas Engine," in *ASME* 2017 *Internal Combustion Engine Division Fall Technical Conference,* 2017, pp. V002T07A008-V002T07A008: American Society of Mechanical Engineers.

[12] M. R. Morovatiyan and V. Hosseini, "Development of a 3D CFD model to analyze gas exchange process into intake manifold of an iVVT engine," *The Journal of Engine Research*, vol. 36, no. 36, pp. 51-60, 2014.

[13] M. Shahsavan and J. H. Mack, "Numerical study of a boosted HCCI engine fueled with n-butanol and isobutanol," *Energy Conversion and Management*, vol. 157, pp. 28-40, 2018.

[14] S. Voshtani, M. Reyhanian, M. Ehteram, and V. Hosseini, "Investigating various effects of reformer gas enrichment on a natural gas-fueled HCCI combustion engine," *International Journal of Hydrogen Energy*, vol. 39, no. 34, pp. 19799-19809, 2014 Nov. 202014.

[15] G. E. Bogin, J. H. Mack, and R. W. Dibble, "Homogeneous charge compression ignition (HCCI) engine," *SAE International Journal of Fuels and Lubricants*, vol. 2, no. 2009-01-1805, pp. 817-826, 2009.

[16] E. Ansari, K. Poorghasemi, B. K. Irdmousa, M. Shahbakhti, and J. Naber, "Efficiency and Emissions Mapping of a Light Duty Diesel-Natural Gas Engine Operating in Conventional Diesel and RCCI Modes," SAE Technical Paper 0148-7191, 2016.

[17] R. D. Reitz and G. Duraisamy, "Review of high efficiency and clean reactivity controlled compression ignition (RCCI) combustion in internal combustion engines," *Progress in Energy and Combustion Science*, vol. 46, pp. 12-71, 2015.

[18] G. T. Kalghatgi, "Spark ignition, early flame development and cyclic variation in IC engines," SAE Technical Paper 0148-7191, 1987.

[19] J. E. Dec, "Advanced compression-ignition engines—understanding the in-cylinder processes," *Proceedings of the combustion institute*, vol. 32, no. 2, pp. 2727-2742, 2009.

[20] L. M. Pickett, S. Kook, H. Persson, and Ö. Andersson, "Diesel fuel jet lift-off stabilization in the presence of laser-induced plasma ignition," *Proceedings of the Combustion Institute*, vol. 32, no. 2, pp. 2793-2800, 2009.

[21] B. Wolk, A. DeFilippo, J.-Y Chen, R. Dibble, A. Nishiyama, and Y. Ikeda, "Enhancement of flame development by microwave-assisted spark ignition in constant volume combustion chamber," *Combustion and flame*, vol. 160, no. 7, pp. 1225-1234, 2013.

[22] J. S. Townsend, *Electricity in gases.* Рипол Классик, 1915.

[23] T. Badawy, X. Bao, and H. Xu, "Impact of spark plug gap on flame kernel propagation and engine performance," *Applied energy*, vol. 191, pp. 311-327, 2017.

[24] S. P. Bane, J. L. Ziegler, and J. E. Shepherd, "Investigation of the effect of electrode geometry on spark ignition," *Combustion and Flame*, vol. 162, no. 2, pp. 462-469, 2015.

[25] A. A. Abdel-Rehim, "Impact of spark plug number of ground electrodes on engine stability," *Ain Shams Engineering Journal*, vol. 4, no. 2, pp. 307-316, 2013.

[26] R. Moos, F. Rettig, A. Hürland, and C. Plog, "Temperature-independent resistive oxygen exhaust gas sensor for lean-burn engines in thick-film technology," *Sensors and Actuators B: Chemical*, vol. 93, no. 1, pp. 43-50, 2003 Aug. 12003.

[27] M. Sjöberg and W. Zeng, "Combined effects of fuel and dilution type on efficiency gains of lean well-mixed DISI engine operation with enhanced ignition and intake heating for enabling mixed-mode combustion," *SAE International Journal of Engines*, vol. 9, no. 2016-01-0689, pp. 750-767, 2016.

[28] M. Perin and T. Achek, "Lean Burn Engines," SAE Technical Paper 0148-7191, 2013.

[29] M. Shen, J. E. Carey, C. H. Crouch, M. Kandyla, H. A. Stone, and E. Mazur, "High-density regular arrays of nanometer-scale rods formed on silicon surfaces via femtosecond laser irradiation in water," *Nano letters*, vol. 8, no. 7, pp. 2087-2091, 2008.

[30] S. Berger, "Onset or breakdown voltage reduction by electrode surface roughness in air and SF 6," *IEEE Transactions on Power Apparatus and Systems*, vol. 95, no. 4, pp. 1073-1079, 1976.

[31] S. Sato and K. Koyama, "Relationship between electrode surface roughness and impulse breakdown voltage in vacuum gap of Cu and Cu—Cr electrodes," *IEEE transactions on dielectrics and electrical insulation*, vol. 10, no. 4, pp. 576-582, 2003.

[32] K. L. Cashdollar, I. A. Zlochower, G. M. Green, R. A. Thomas, and M. Hertzberg, "Flammability of methane, propane, and hydrogen gases," *Journal of Loss Prevention in the Process Industries*, vol. 13, no. 3-5, pp. 327-340, 2000.

[33] Y. Shoshin and L. De Goey, "Experimental study of lean flammability limits of methane/hydrogen/air mixtures in tubes of different diameters," *Experimental Thermal and Fluid Science*, vol. 34, no. 3, pp. 373-380, 2010.

[34] S. R. Turns, *An introduction to combustion*. McGraw-hill New York, 1996.

[35] Z. Wang, M. Alswat, G. Yu, M. O. Allehaibi, and H. Metghalchi, "Flame structure and laminar burning speed of gas to liquid fuel air mixtures at moderate pressures and high temperatures," *Fuel*, vol. 209, pp. 529-537, 2017 Dec. 12017.

What is claimed is:

1. A method of operating a combustion chamber, comprising:

transferring an air/fuel mixture into the combustion chamber occupied by a spark plug having first electrode and a second electrode, at least one of the first electrode and second electrode defining features having a surface roughness in a direction of a spark gap between the first electrode and a second electrode;

controlling an operation parameter as a function of the surface roughness, the operation parameter being one of a ratio of air to fuel of the air/fuel mixture and power applied to the spark plug;

applying a voltage to a terminal of the spark plug to generate a spark at the spark gap;

igniting the air/fuel mixture via the spark.

2. The method of claim 1, wherein the operation parameter is the ratio of air to fuel of the air/fuel mixture, the air/fuel mixture having an effective lean flammability limit that is reduced relative to an effective lean flammability limit associated with a spark plug that is absent surface roughness.

3. The method of claim 1, wherein the operation parameter is the power applied to the spark plug, the surface roughness enabling a reduction in the power applied to the spark plug to generate the spark at the spark gap, the spark having a magnitude equivalent to a spark generated at a greater power and absent the surface roughness at the spark plug.

4. The method of claim 1, wherein the surface roughness is generated via at least one of an irradiation, a mechanical abrasion, a chemical treatment, and a femtosecond pulsed laser beam applied to a surface of the at least one of the first electrode and second electrode.

5. The method of claim 4, wherein the first electrode is a cathode electrode and the second electrode is an anode electrode, and wherein the anode electrode defines the surface roughness.

6. The method of claim 4, wherein the first electrode is a cathode electrode and the second electrode is an anode electrode, and wherein the cathode electrode defines the surface roughness.

7. The method of claim 4, wherein the first electrode is a cathode electrode and the second electrode is an anode electrode, and wherein the first electrode defines a first surface roughness and the second electrode defines a second surface roughness, wherein the first surface roughness and second surface roughness are within the same order of rms magnitude from each other.

8. The method of claim 4, wherein the first electrode is a cathode electrode and the second electrode is an anode electrode, and wherein the first electrode defines a first surface roughness and the second electrode defines a second surface roughness, wherein the first surface roughness and second surface roughness differ in rms magnitude from each other by at least one order of magnitude.

9. The method of claim 4, wherein the features include nanometer-scale structural features having a size between 10 and 1000 nanometers.

10. The method of claim 4, wherein the features include micrometer-scale structural features having a size between 1 and 300 micrometers.

* * * * *